US006725698B2

(12) United States Patent
Endo

(10) Patent No.: US 6,725,698 B2
(45) Date of Patent: Apr. 27, 2004

(54) METHOD FOR FORMING TUBE END

(75) Inventor: Akihiro Endo, Ohta (JP)

(73) Assignee: Sakamoto Industry Co., Ltd., Ohta (JP)

( * ) Notice: Subject to any disclaimer, the term of this patent is extended or adjusted under 35 U.S.C. 154(b) by 0 days.

(21) Appl. No.: 10/005,260

(22) Filed: Dec. 3, 2001

(65) Prior Publication Data

US 2002/0194892 A1 Dec. 26, 2002

(30) Foreign Application Priority Data

Jun. 26, 2001 (JP) ..... 2001-192640

(51) Int. Cl.[7] ..... B21D 3/02; B21D 22/00

(52) U.S. Cl. ..... 72/120; 72/84; 72/370.1; 72/370.23

(58) Field of Search ..... 72/120, 121, 125, 72/126, 84, 82, 83, 85, 370.01, 370.23, 370.24

(56) References Cited

U.S. PATENT DOCUMENTS

| | | | | | |
|---|---|---|---|---|---|
| 1,751,085 A | * | 3/1930 | Hopkins | ..... | 72/121 |
| 2,227,817 A | * | 1/1941 | Allen | ..... | 72/370.12 |
| 6,212,926 B1 | * | 4/2001 | Jenness | ..... | 72/69 |
| 6,386,010 B1 | * | 5/2002 | Irie et al. | ..... | 72/84 |
| 6,467,322 B2 | * | 10/2002 | Nogami et al. | ..... | 72/121 |

FOREIGN PATENT DOCUMENTS

| | | | | |
|---|---|---|---|---|
| EP | 0774308 A1 | * | 5/1997 | ..... B21D/22/16 |
| FR | 1453669 | * | 9/1966 | |
| JP | 0258834 | * | 4/1989 | |
| JP | 03-226327 | | 10/1991 | |
| JP | 2000 051961 A | | 2/2000 | |
| JP | 2000 317532 A | | 11/2000 | |
| WO | WO 00/05007 A | | 2/2000 | |

* cited by examiner

*Primary Examiner*—Allen Ostrager
*Assistant Examiner*—John S Goetz
(74) *Attorney, Agent, or Firm*—Brown & Michaels, PC

(57) ABSTRACT

At the time of spinning a tip reduced portion 3, an angle of inclination of the outer periphery of the tip reduced portion 3 with respect to an axis of a tube stock 2 is increased on a center side of the tube stock 2 and reduced on an end edge side thereof. By this, a generating line of an outer peripheral surface of the tip reduced portion 3 is made into a form like a center recessed curved surface.

3 Claims, 6 Drawing Sheets

METHOD FOR FORMING TUBE END

BACKGROUND OF THE INVENTION

This invention relates to a method for forming an end portion of a tube used for a muffler of a vehicle, etc. and more particularly to a method for forming an end portion of a flattened tube which has a short axis direction and a long axis direction in section, the flattened tube having such a configuration in section as elliptic, rectangular, or the like.

In recent vehicles, a tube having an elliptic configuration in section is often used as a tube constituting a muffler. The reason is that the tube having an elliptic configuration in section has a long axis direction and a short axis direction and therefore, it can exhibit such an advantage in respect of layout as being able to reduce the width in the up and down direction compared with a sectional area thereof by placing the tube such that the short axis direction is oriented to the up and down direction.

Incidentally, an exhaust tube connected to the muffler has a circular configuration in section and in addition, it has a smaller diameter than the elliptic tube constituting the muffler. For this reason, as shown in FIGS. 16 through 18, a taper-like tip reduced portion a and a connecting portion b having a circular configuration in section and having an even diameter are formed on opposite end portions of an elliptic tube A constituting the muffler by spinning. The connecting portion b is fittingly connected to an exhaust tube (not shown).

When the tip reduced portion a is formed on the end portion of the elliptic tube A by spinning, a projection c projecting in a short axis direction is, as shown in FIG. 17, formed on an intersection part between the outer periphery of the elliptic tube A in the short axis direction and the outer periphery of the tip reduced portion a on the enlarged diameter side end portion. This projection c brings about such a problem that it interferes with other members of the vehicle. In order to avoid this problem, it is generally practiced that a post machining is executed in order to depress the projection c so as to be roughly flattened after the process for machining the tip reduced portion a. However, in the case where a projecting amount $d_1$ of the projection c is overly large, the area of the intersection part where the projection c is formed is depressed or a waving phenomenon occurs in which wrinkles are formed on the tip reduced portion a, after the post machining. Therefore, it is demanded that the projecting amount $d_1$ is diminished as much as possible.

SUMMARY OF THE INVENTION

The present invention has been made in order meet with the above-mentioned demand. According to the present invention, there is provided in a method for forming, on an end portion of a tube stock, a tip reduced portion having a circular configuration in section which is gradually reduced in diameter from a center side of the tube stock towards an end edge side thereof by relatively rotating a forming tool about an axis of the tube stock and moving the forming roll towards the axis of the tube stock as the forming roll is moved from the center side of the tube stock towards the end edge side thereof while pressing the forming tool against an outer periphery of the end portion of the tube stock which outer periphery has a sectional configuration having different lengths in two mutually orthogonal directions, a method for forming a tube end comprising the step for forming the tip reduced portion of the tube stock such that an angle of inclination of an outer periphery of the tip reduced portion with respect to an axis of the tube stock is gradually reduced from the center side of the tube stock towards the end edge side thereof so that a generating line of the outer periphery of the tip reduced portion becomes a center recessed curve.

It is accepted that the forming process by the forming tool is repeated plural times so that the tip reduced portion is gradually finished from the center side of the tube stock in every forming process or that through repetition of the forming process plural times using the forming tool, the end portion of the tube stock is reduced in diameter in every forming process and the entirety of the tip reduced portion is formed in a final forming process.

DETAILED DESCRIPTION OF THE INVENTION

Embodiments of the present invention will be described hereinafter with reference to FIGS. 1 through 15.

Figure 1:
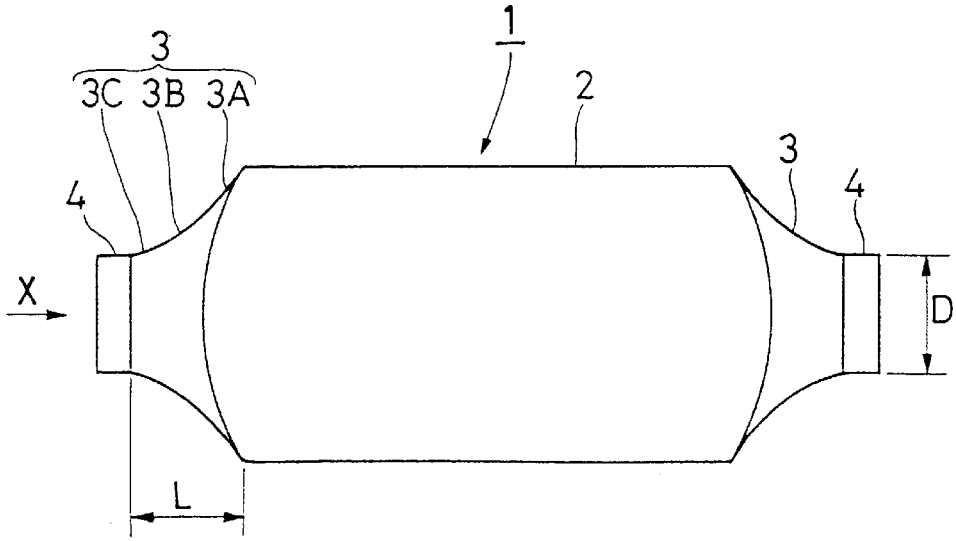
FIG. 1 is a plan view showing one example of a casing of a muffler which is formed by a forming method according to the present invention.
Figure 2:
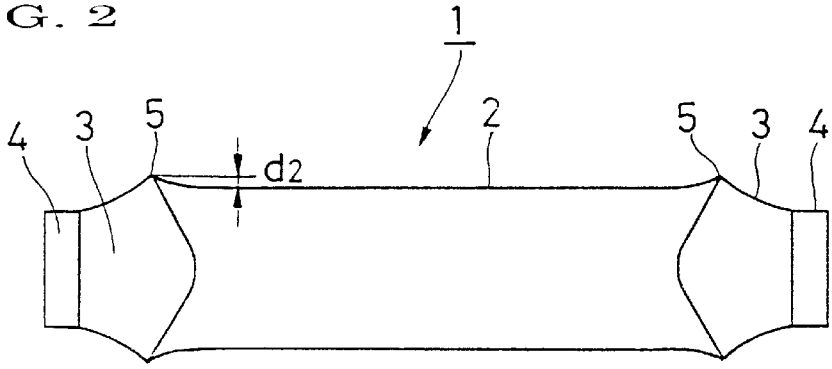
FIG. 2 is a front view of the above casing.
Figure 3:
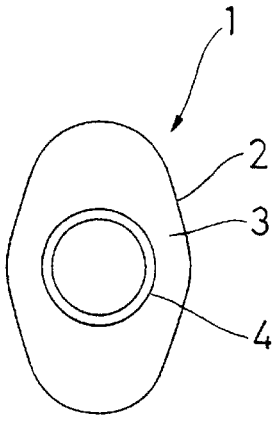
FIG. 3 is a view when viewed in a direction as indicated by an arrow X of FIG. 1.

First, a casing 1 of a muffler formed by a method for forming a tube end according to the present invention with reference to FIGS. 1 through 3. This casing 1 is obtained by forming opposite end portions of a tube stock 2 having an elliptic configuration in section by a forming method according to the present invention. At each end portion of the tube stock 2, a tip reduced portion 3 and a connecting portion 4 are formed from the center side of the tube stock 2 towards the end portion side thereof in this order.

The tip reduced portion 3 is aligned in its axis with that of the stock tube 2 and formed gradually narrower from the center side of the tube stock 2 towards the distal end side thereof. The reducing ratio of the tip reduced portion 3 is comparatively large on the center side and comparatively small on the distal end (end edge) side. In other words, an angle of inclination an outer peripheral surface of the tip reduced portion 3 with respect to the axis of the tube stock 2 is large on the center side and is gradually reduced from the center side towards the distal end side. As a result, a generating line (crossing line between a plane including a center line of the tip reduced portion 3 and an outer peripheral surface of the tip reduced portion 3) of the outer peripheral surface of the tip reduced portion 3 is in the form of a center recessed curve.

The connecting portion 4 is arranged such that its axis is aligned with the axis of the tip reduced portion 3. The connecting portion 4 is in the form of a straight sleeve which is circular in section whose inside and outside diameters are fixed. The outside diameter of the connecting portion 4 is same as the outside diameters of the distal end portion of the tip reduced portion 3. An exhaust tube (not shown) is fittingly connected to an inner or outer periphery of the connecting portion 4.

A method for forming the tip reduced portion 3 and the connecting portions 4 of the casing 1 thus constructed will be described. The tip reduced portion 3 and the connecting portion 4 are formed by spinning. Spinning is executed by revolving a forming roll (forming tool) R about an axis of the tube stock 2 while pressing the forming roll R against the tube stock 2 to form the tip reduced portion 3 and the connecting portion 4. Since spinning itself is known, detailed description thereof is omitted.

FIGS. 4 through 9 show one embodiment of a case in which the tip reduced portion 3 and the connecting portion 4 are formed on the end portion of the stock tube 2 by spinning. In this embodiment, forming of the end portion of the stock tube 2, namely, forming of the tip reduced portion 3 and the connecting portion 4 is completed by three forming processes. Forming is gradually executed from an enlarged diameter side of the tip reduced portion 3.

Figure 4:
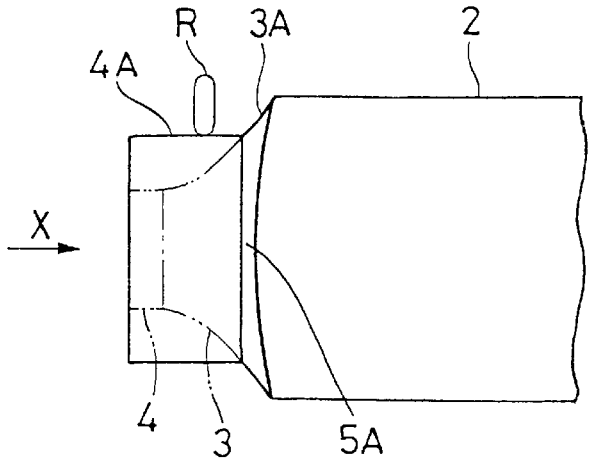
FIG. 4 is a plan view showing a first forming process according to one embodiment of the present invention.
Figure 5:
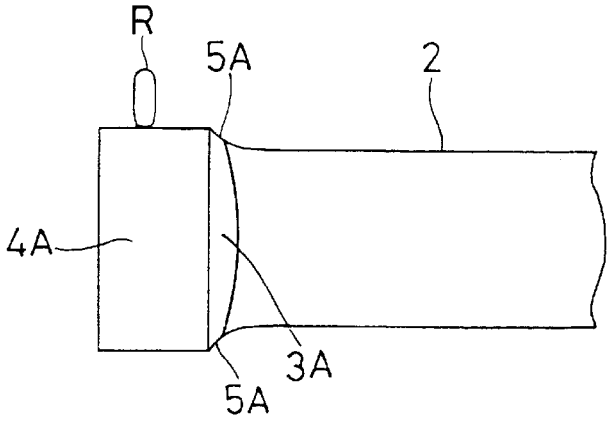
FIG. 5 is a front view thereof.
Figure 6:
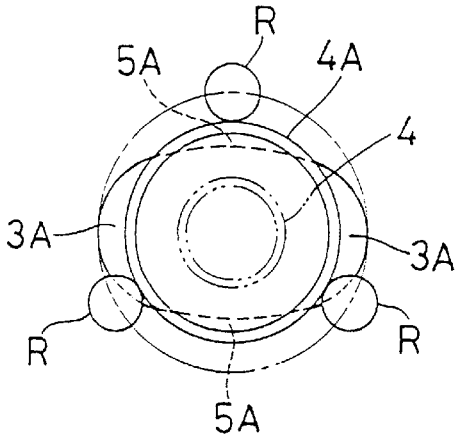
FIG. 6 is a view when viewed in a direction as indicated by an arrow X of FIG. 4.

Specifically, as shown in FIGS. 4 through 6, in the first forming process, an enlarged diameter side end portion 3A and a first straight portion 4A continuous with the portion 3A on the side of the end portion of the stock tube 2 are formed. The configuration of the enlarged diameter side end portion 3A is identical with that of the end portion of the tip reduced portion 3 on the enlarged diameter side (center side of the tube stock 2). On the other hand, the first straight portion 4A has a circular configuration in section which is even in inside and outside diameters over an entire length thereof. The outside diameter of the portion 4A is set to roughly an intermediate value of a long axis length (outside diameter of the tube stock 2 in a long axis direction) and short axis direction (outside diameter of the tube stock 2 in a short axis direction) of the tube stock 2. The outside diameter of the first straight portion 4A is same as the outside diameter of the enlarged diameter side end portion 3A on the reduced diameter side end edge. Accordingly, the length of the enlarged diameter side end portion 3A formed in the first forming process is determined by position where the outside diameter of the reduced diameter side end edge becomes same as the outside diameter of the first straight portion 4A.

The enlarged side end portion 3A can be formed by moving the forming roll R towards the axis of the tube stock 2 as the forming roll R is moved from the center side of the tube stock 2 towards the distal end side thereof. Of course, since the reducing ratio of the tip reduced portion 3 is comparatively large on the center side and comparatively small on the distal end edge side, the forming roll R is also moved in match therewith. On the other hand, the first straight portion 4A can be formed by moving the forming roll R in parallel with the axis of the tube stock 2. Since the outside diameter of the straight portion 4A is larger than the outside diameter of the tube stock 2 in the short axis direction, a tip enlarged portion 5A, which is gradually increased in diameter from the center side of the tube stock 2 towards the distal end side thereof, is formed between the straight portion 4A and an outer peripheral portion of the tube stock portion 2 in the short axis direction. This tip enlarged portion 5A is formed into a part of the tip reduced portion 3 in the next second forming process. Accordingly, the tip enlarged portion 5A does not remain as a part of the casing 1.

Figure 7:
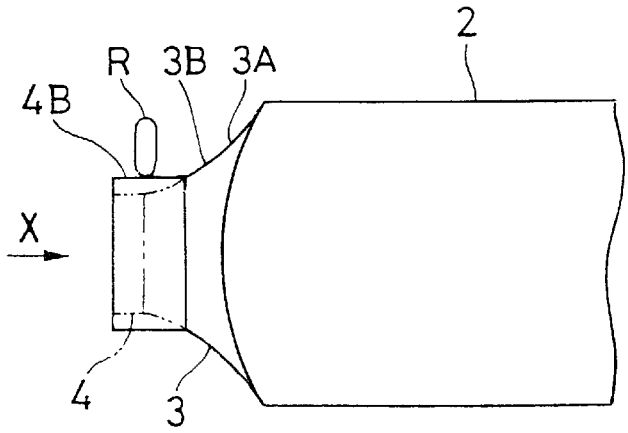
FIG. 7 is a plan view showing a second forming process according to the above embodiment.
Figure 8:
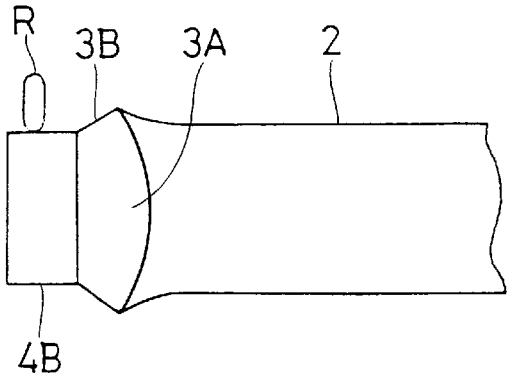
FIG. 8 is a front view thereof.
Figure 9:
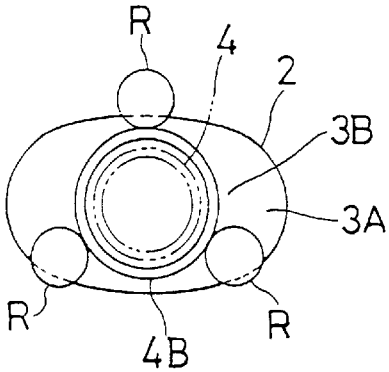
FIG. 9 is a view when viewed in a direction as indicated by an arrow X of FIG. 7.

FIGS. 7 through 9 show the second forming process. In this second forming process, an intermediate portion 3B continuous with the enlarged diameter side end portion 3A as a part of the tip reduced portion 3 and a second straight portion 4B continuous with the intermediate portion 3B are formed. The outside diameter of the second straight portion 4B is set to roughly an intermediate value of the outside diameter (length) of the tube stock 2 in a short axis direction and the outside diameter of the connecting portion 4. The length of the intermediate portion 3B is defined in such a manner as to correspond to the outside diameter of the second straight portion 4B. The intermediate portion 3B and the second straight portion 4B can be formed in the same manner as the enlarged diameter side end portion 3A and the first straight portion 4A, respectively.

In the final third forming process, a reduced diameter side end portion 3C as the remaining part of the tip reduced portion 3 and the connecting portion 4 are formed. The reduced diameter side end portion 3C can be formed in the same manner as the enlarged diameter side end portion 3A and intermediate portion 3B, while the connecting portion 4 can be formed in the same manner as the first and second straight portions 4A, 4B.

In the case where the tip reduced portion 3 is formed in the manner as mentioned above, there is a possibility that a small step is formed on an area (connecting portions among the portions 3A, 3B and 3C) between two of every adjacent portions 3A, 3B and 3C. Therefore, it is preferred that after the third process, a finishing process is employed in which the forming roll R is moved along the entire tip reduced portion 3 while being contacted with the tip reduced portion 3. At that time, it is also preferred to finish such that the enlarged diameter side end portion 3A, the intermediate portion 3B and the reduced diameter side end portion 3C each have a finish margin. It is not absolutely necessary to complete the forming operation strictly in three forming processes. It may be only one process or two processes. It may also be four or more processes.

In the case where the reducing ratio of the tip reduced portion 3 is comparatively large on the center side and comparatively small on the distal end edge side and thereby the angle of inclination of the outer peripheral surface of the tip reduced portion 3 with respect to the axis of the tube stock 2 is large on the center side of the tube stock 2 and is gradually reduced towards the distal end side as mentioned above, the height $d_2$ of a projection 5 formed at an intersection part between the outer periphery of the tube stock 2 in the short axis direction and the outer periphery of the tip reduced portion 3 on the large diameter side can be diminished extensively compared with the conventional case where the taper-like tip reduced portion is formed as apparent from a result of an experiment as later described.

A second embodiment of a forming method according to the present invention will now be described with reference to FIGS. 10 through 15. In this second embodiment, the tip reduced portion 3 and the connecting portion 4 are also formed in three forming processes. However, in this second embodiment, the tip reduced portion 3 is not gradually formed from an enlarged side thereof. Instead, in this second embodiment, the end portion of the tube stock 2 is gradually reduced in diameter in each of the first and second forming processes, and forming of the entire tip reduced portion 3 and connecting portion 4 is completed in the third forming process as a final process.

Figure 10:
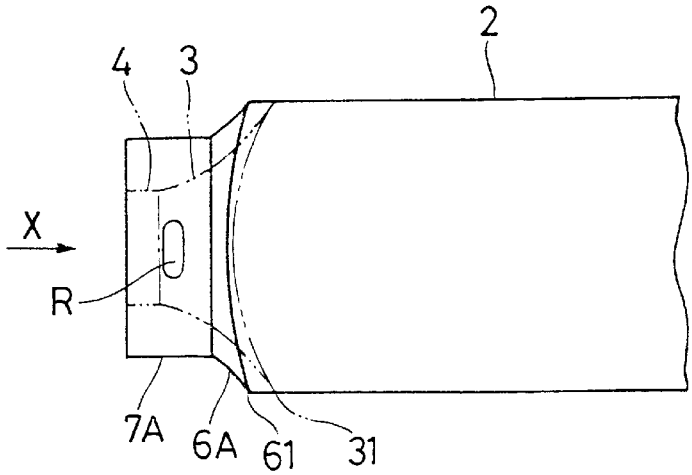
FIG. 10 is a plan view showing a first forming process according to another embodiment of the present invention.

That is, in the first forming process of the second embodiment, a first tip reduced portion 6A and a first cylindrical portion 7A are gradually formed on the end portion of the tube stock 2 from the center side towards the end edge side. The first tip reduced portion 6A is shaped by forming the end portion of the tube stock 2 in such a manner as to be gradually reduced in diameter from the center side towards the end portion side. The portion 6A has roughly a same configuration as the end portion of the tip reduced portion 3 on the enlarged diameter side. A start point 61 from where the first tip reduced portion 6A starts is, as shown in FIG. 10, located more on the end portion side of the tube stock 2 than a start point 31 of the tip reduced portion 3. That is, the first tip reduced portion 6A is located more on the end portion side of the tube stock 2 than the tip reduced portion 3. As a result, the outside diameter of the first tip reduced portion 6A is larger than the outside diameter of the tip reduced portion 3 at the same position in the axis direction of the tube stock 2. About a half the difference in diameter between the first tip reduced portion 6A and the tip reduced portion 3 serves as a machining margin in the next second forming process.

Figure 11:
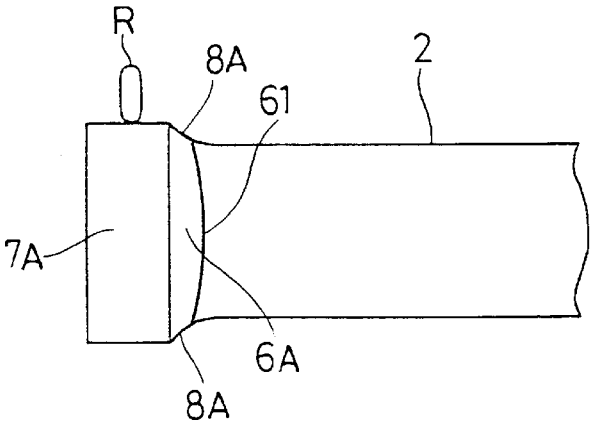
FIG. 11 is a front view thereof.
Figure 12:
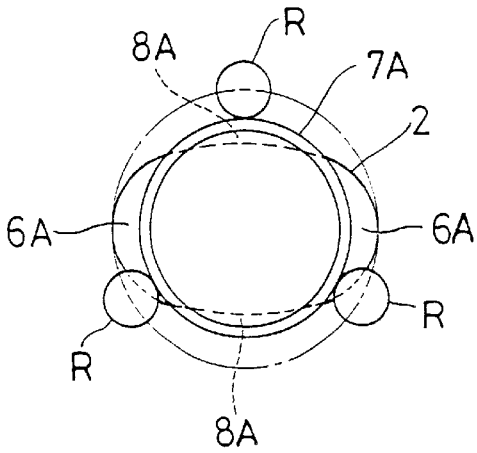
FIG. 12 is a view when viewed in a direction as indicated by an arrow X of FIG. 10.

The first cylindrical portion 7A is formed in a cylindrical configuration which is circular in section and has fixed inside and outside diameters. As shown in FIG. 12, the outside diameter of the first cylindrical portion 7A is set to roughly an intermediate value of the outside diameter of the tube stock 2 in the long axis direction and the outside diameter of the tube stock 2 in the short axis direction. As in the above embodiment, the length of the first tip reduced portion 6A is determined in such a manner as to correspond to the outside diameter of the first cylindrical portion 7A. Also, as shown in FIG. 11, at the time the first forming process is completed, a tip enlarged portion 8A, which is gradually enlarged in diameter from the center side of the tube stock 2 towards the first cylindrical portion 7A side, is formed between the outer peripheral surface of the tube stock 2 in the short axis direction and the first cylindrical portion 7A. This tip enlarged portion 8A is finally formed on a part of the tip reduced portion 3 as in the above-mentioned tip enlarged portion 5A.

Figure 13:
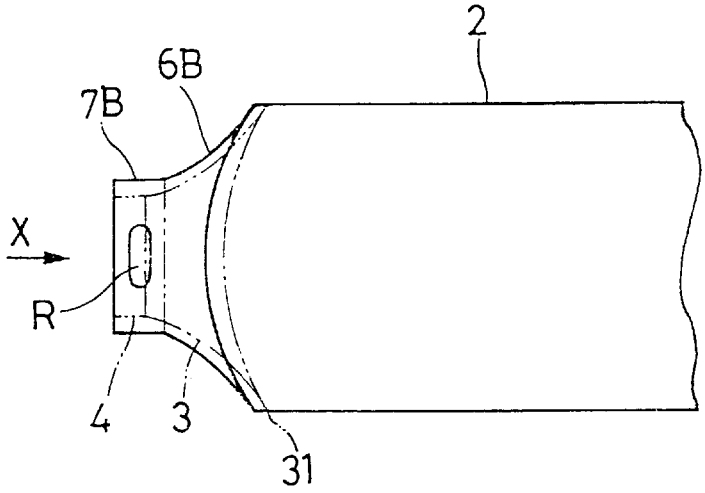
FIG. 13 is a plan view showing a second forming process according to the above embodiment.
Figure 14:
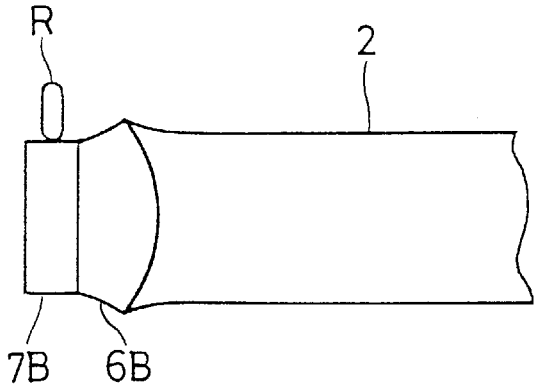
FIG. 14 is a front view thereof.
Figure 15:
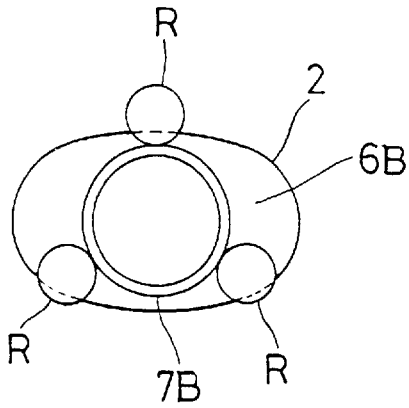
FIG. 15 is a view when viewed in a direction as indicated by an arrow X of FIG. 13.
Figure 16:
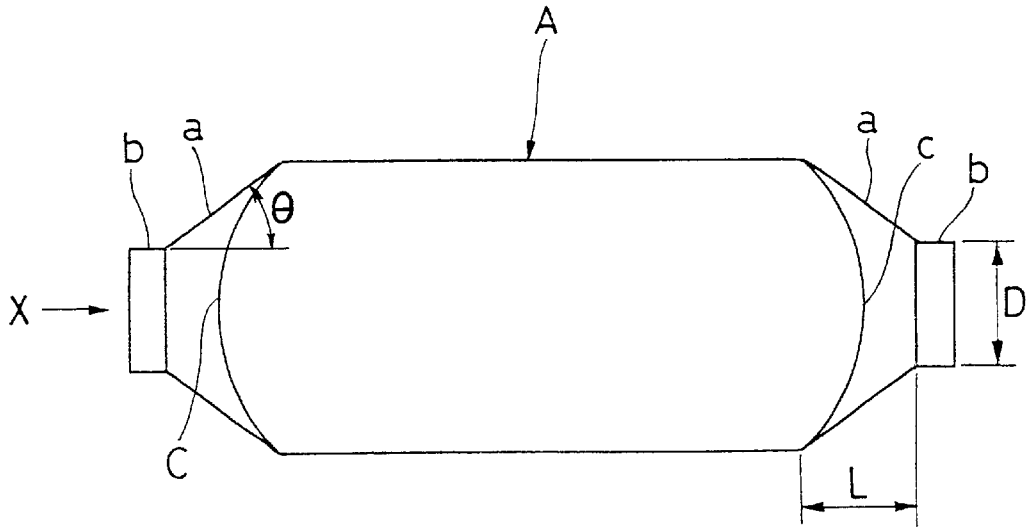
FIG. 16 is a plan view showing one example of a casing of a muffler which is formed by a conventional forming method.
Figure 17:
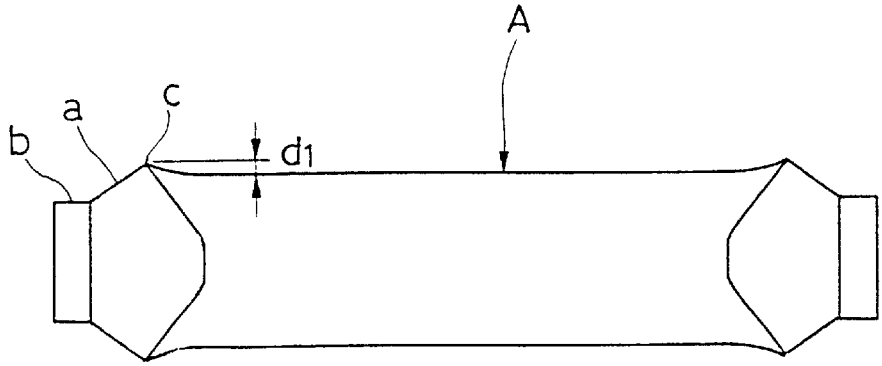
FIG. 17 is a front view of the above casing.
Figure 18:
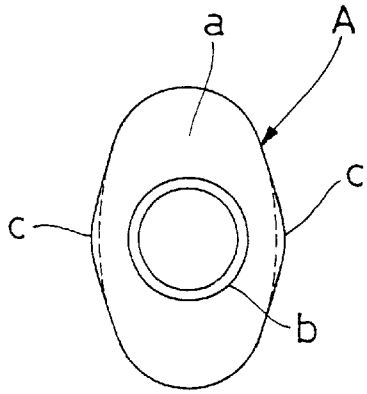
FIG. 18 is a view when viewed in a direction as indicated by an arrow X of FIG. 16.

In the second forming process shown in FIGS. 13 through 15, a second tip reduced portion 6B and a second cylindrical portion 7B are formed. The second tip reduced portion 6B and the second cylindrical portion 7B are machined such that they have intermediate configurations and dimensions of the tip reduced portion 3 and the connecting portion 4, and the first tip reduced portion 6A and the first cylindrical portion 7A, respectively. At the time the second forming process is completed, as shown in FIG. 15, the outside diameter of the second cylindrical portion 7B is smaller than the outside diameter of the tube stock 2 in the short axis direction. As a result, the second tip reduced portion 6B is formed on the tube stock 2 over the entire periphery thereof, and the tip enlarged portion 8A formed in the first forming process is formed as a part of the second tip reduced portion 6B.

When the second forming process is completed, the tip reduced portion 3 and the connecting portion 4 are formed in the third forming process. By this, forming of the tube end portion of the tube stock 2 is completed.

In this second embodiment, it is not absolutely necessary to form the tip reduced portion 3 and the connecting portion 4 in three processes, either. For example, it is accepted that a small finish margin is left at the time of completion of the third forming process and a finish forming process is employed after the third forming process so that the tip reduced portion 3 and the connecting portion 4 are formed in this finish forming process. It is possible that the tip reduced portion 3 and the connecting portion 4 are formed only in one process by reducing the moving speed of the forming roll R in the axis direction of the tube stock 2. It is also possible to form the tip reduced portion 3 and the connecting portion 4 in other plural forming processes than three processes.

An experiment will be explained next which is carried out for confirming such a result of the present invention as being able to reduce the height of the protection formed on the intersection part between the outer periphery of the tube stock 2 in the short axis direction and the outer periphery of the tip reduced portion 3. In this experiment, the conditions of the comparative example are set to be same as those of the present invention only except that while the generating line of the outer periphery of the tip reduced portion 3 is formed in a recessed curve, the generating line of an outer periphery of a conventional tip reduced portion a as a comparable object is formed in a straight line. The conditions of this experiment are as follows. As the tube stock 2, a tube stock was used having a length of 158 mm in a long axis direction, a length of 94 mm in the short axis direction and a thickness of 1.5 mm. The length L of the tip reduced portion 3 of the present invention and the length L of the conventional tip reduced portion a were set to 60 mm, and the outside diameters (outside diameters D of the connecting portions 4, b) of the tip reduced portions 3, a on the reduced diameter side end portion were set to 65 mm. The result was that the angle of inclination θ of the outer periphery of the tip reduced portion a was 36 degrees in the outer periphery of the conventional one while the inclination angles at the opposite end portions of the tip reduced portion 3 on the center side of the tube stock 2 and on the connecting portion 4 side were 76 degrees and 14 degrees, respectively and the curvature of radius of the generating line was about 100 mm in the present invention. The feed speed of the forming roll R was set to 3000 mm/min in the axis direction of the tube stock 2, and the revolving speed was set to 550 rpm.

Under the above-mentioned conditions, the tip reduced portions 3, a and the connecting portions 4, b were formed. The result was that while the height $d_1$ of the projection c was about 7 mm in the conventional one, the height $d_2$ of the projection 5 was 5 mm in the present invention. Accordingly, the height of the projection 5 could be reduced about 30%.

The present invention is not limited to the above embodiments. Instead, many changes and modifications can be made in accordance with necessity.

For example, in the above-mentioned embodiments, although the tube stock 2 having a circular configuration in section is formed, the present invention can likewise be applied to various kinds of tube stocks having, in section, a rectangular configuration, a diamond configuration, a trapezoidal configuration, an isosceles triangle configuration or the like.

Moreover, in the above-mentioned embodiments, although the forming roll R is rotated about the tube stock 2, it is also accepted that the circumferential position of each forming roll R is fixed and the tube stock 2 is rotated with respect to the forming roll R. In addition, although three forming rolls R are employed in the above-mentioned embodiments, only one or other plural rollers than three may be employed.

What is claimed is:

1. A method of forming, on an end portion of a tube stock, a tip reduced portion having a circular configuration in section which is gradually reduced in diameter from a center side of said tube stock towards an end edge side of said tube stock comprising the steps of:

relatively rotating a forming tool about an axis of said tube stock;

moving said forming tool towards the axis of said tube stock as said forming tool is moved from the center side of said tube stock towards the end edge side thereof while pressing said forming tool against an outer periphery of the end portion of said tube stock, which outer periphery has a sectional configuration having different lengths in two orthogonal directions with respect to the axis of the tube stock; and forming said tip reduced portion of said tube stock such that an angle of inclination of an outer periphery of said tip reduced portion with respect to the axis of said tube stock is gradually reduced from the center side of said tube stock towards the end edge side of the tube stock so that a generating line of the outer periphery of said tip reduced portion becomes in final form a center recessed curve and reduced short axis projections are formed.

2. The method of claim 1, wherein the step of moving said forming tool is repeated a plurality of times so that said tip reduced portion is gradually finished from the center side of said tube stock towards the end edge side of said tube stock.

3. The method of claim 1, wherein through repetition of the step of moving said forming tool, the end portion of said tube stock is reduced in diameter and the entirety of said tip reduced portion is formed in accordance with said step of forming said tip reduced portion of the tube stock.

* * * * *